US006378778B1

(12) United States Patent
Lurås

(10) Patent No.: US 6,378,778 B1
(45) Date of Patent: Apr. 30, 2002

(54) SNOW GUN

(75) Inventor: Arne Widar Lurås, Oslo (NO)

(73) Assignee: Crea AS, Oslo (NO)

( * ) Notice: Subject to any disclaimer, the term of this patent is extended or adjusted under 35 U.S.C. 154(b) by 0 days.

(21) Appl. No.: 09/701,785

(22) PCT Filed: Jun. 1, 1999

(86) PCT No.: PCT/NO99/00173

§ 371 Date: Jan. 22, 2001

§ 102(e) Date: Jan. 22, 2001

(87) PCT Pub. No.: WO99/63286

PCT Pub. Date: Dec. 9, 1999

(30) Foreign Application Priority Data

Jun. 2, 1998 (NO) ..... 1998 2507

(51) Int. Cl.[7] ..... F25C 3/04

(52) U.S. Cl. ..... 239/14.2; 239/2.2

(58) Field of Search ..... 239/14.2, 2.2, 239/132.1, 418, 419.5, 421, 423, 426, 433, 553.3, 553.5, 601; 62/121, 74, 347, 314

(56) References Cited

U.S. PATENT DOCUMENTS

| | | | | |
|---|---|---|---|---|
| 3,596,476 A | | 8/1971 | Jakob et al. | |
| 3,908,903 A | | 9/1975 | Burns, Jr. | |
| 4,491,273 A | | 1/1985 | Manhart | |
| 4,516,722 A | | 5/1985 | Avery | |
| 4,682,729 A | | 7/1987 | Doman et al. | |
| 4,742,959 A | | 5/1988 | Stanchak et al. | |
| 4,828,175 A | | 5/1989 | Heufler et al. | |
| 4,836,446 A | * | 6/1989 | Chanel | 239/2.2 |
| 4,915,302 A | | 4/1990 | Kraus et al. | |
| 4,919,331 A | * | 4/1990 | Kosik, Sr. et al. | 239/2.2 |
| 5,322,218 A | * | 6/1994 | Melbourne | 239/2.2 |
| 5,400,966 A | * | 3/1995 | Weaver et al. | 239/2.2 |
| 5,836,513 A | * | 11/1998 | Smith et al. | 239/2.2 |

FOREIGN PATENT DOCUMENTS

| | | |
|---|---|---|
| DE | 19523052 A1 | 12/1996 |
| EP | 0089590 A1 | 9/1983 |
| EP | 0206705 A1 | 12/1986 |
| EP | 0277933 A2 | 8/1988 |
| FR | 2725502 A1 | 4/1996 |
| NO | 124559 | 8/1972 |
| NO | 154322 | 5/1986 |
| SE | 503381 | 6/1996 |
| SU | 1237876 A | 6/1986 |
| WO | WO 9609505 | 3/1996 |

* cited by examiner

*Primary Examiner*—David A. Scherbel
*Assistant Examiner*—Davis Hwu
(74) *Attorney, Agent, or Firm*—Young & Thompson

(57) ABSTRACT

A snow gun (40) having outlet (43), for cold compressed air (42) and outlet (44) for water (49) discharged under pressure. The snow gun (40) has a tubular housing (41), and said outlet for water consists of nozzles (44) disposed along a ring-shaped cross-sectional area of the housing and wherein each nozzle forms an angle relative to the internal wall **(41*b*) of the housing, that the water jets from the nozzles (44), where they meet upstream in relation to the outlet aperture (45) of the housing, form a configuration having approximately the shape of a polygon or circle (47), and that the ring of nozzles (44) is located downstream in relation to the compressed air outlet (43) where the compressed air expands and upstream in relation to the outlet aperture (45) of the housing, and that both the outlet (43) for compressed air (42) and the water nozzles (44) are thus surrounded by the tubular housing (41) within the inlet end (41*a*) and the outlet aperture (45) of the housing. The outlet (43) for compressed air (42) and the water nozzles (44) are surrounded by a tubular housing (41)** which forms a snow ejector.

5 Claims, 7 Drawing Sheets

SNOW GUN

The present invention relates to a snow gun, that is to say an apparatus for making artificially produced snow.

Today, snow guns which are included in a snow production system on ski slopes are considered to be an important and necessary element in order to ensure a stable operation of the ski area.

Considerable sums are invested in ski areas, but unpredictable and unstable weather conditions, with greatly varying amounts of precipitation in the form of snow, can easily render these capital outlays unprofitable, even in normally snowy districts.

The presence of a snow production system on a slope allows the following to be obtained:

Earlier start to the season. In many places the early part of winter is marked by frost, but little or no snow fall. These are good conditions for snow production.

The advantage of a durable underlying layer of snow. Artificial snow is heavier, denser and more durable than natural snow.

The season can be extended.

Production of snow takes place with the aid of so-called "snow guns", by mixing water and air at high pressure and then spraying the mixture out at high velocity through a nozzle. The mixture expands in a chamber, is supercooled and then hits static surrounding cold air.

New requirements with respect to operating and energy costs have recently focused on automation and conservation of energy in such systems. The major winter sports centres and neighbouring films have gradually become dependent upon a reliable winter season with snow, Earlier, snow production systems were started up once "it was cold enough". Therefore, new requirements have emerged with respect to the effect of the guns and equipment used under marginal conditions in order to secure a season of maximum length.

Natural snow consists of frozen water which has been crystallised in hexagonal shape, forming characteristic snow crystals. The snow crystals change continuously, the snow becomes coarser the older it is. Artificial snow that is produced in snow guns consists of frozen water droplets which have had neither the time nor the opportunity to form natural snow crystals.

The snow produced in a snow gun is formed by supplying water and air under pressure, and the small water droplets which are thrown out of the snow guns are cooled by:

Expansion of compressed air. Air which is compressed becomes warmer, and conversely, it becomes colder on expansion (only in compressed air systems).

Evaporation from the surface of the water droplets. The evaporation "steals" heat from the water droplets.

Contact with surrounding cold air.

Low water and compressed air temperature gives a better starting point for the cooling process.

An important parameter during snow production is the temperature. The production rate of snow will increase with low air temperature, low air humidity, low water temperature and increased cold air volume for expansion.

Cold, dry air will therefore give the best conditions for snow production. It is physically possible to produce snow when the temperature is above freezing. In the compressed air system, which on the expansion of air generates "its own cold", the theoretical limit for conversion to snow at different levels of air humidity varies.

Because the snow tends to melt again at high temperatures, and at the same time the snow production becomes inefficient and expensive, there is a practical limit of +2° C. at a very low level of humidity.

Today there are three main snow gun systems:

| | |
|---|---|
| Water/compressed air system | (formerly known as a high-pressure system), see FIG. 1. |
| Tower gun | (external mixture of water and compressed air), see FIGS. 2a and 2b. |
| Fan system | (formerly known as a low pressure system), see FIGS. 3a and 3b. |

The water/compressed air system (FIG. 1) is based on the snow guns being supplied with air 11 at a pressure of 7–8 bar, and water 10 at a pressure of 8–10 bar. Water under pressure and compressed air are mixed in the snow gun antechamber 12. The water is atomised in the gun by passing through a nozzle 13, whilst air on expansion is cooled to a range of between −30° C. and −40° C. The snow particles 14 are formed in this mixture of atomised water and cooled air. When the snow particles are thrown a long distance at high speed, they will remain longer in the air and this gives increased growth and snow volume. The guns weigh about 10–50 kg.

Tower guns 20 (see FIG. 2*a*) are often mounted on separate posts 21, masts or the like. A water pressure in the range of about 14–50 bar is used. The water is forced through inclined nozzles 23 on each side of the tower gun (see also FIG. 2*b*). The mixture of air 24 and water 22 takes place outside the snow gun downstream in relation to the nozzle which discharges compressed air. Because the gun is mounted above the ground (8–12 meters), the snow particles have a long fall before they reach the ground and thus a longer crystallisation process. Among the disadvantages of these tower guns are that the snow is blown away if wind directions are unfavourable, and also that an optimum mixture of the water and the expanding, cooled air is not obtained.

Fan system 30 (see FIGS. 3*a* and 3*b*) is based on water 31 being supplied at a pressure of about 15–40 bar. The compressed air having a pressure in the range of about 8–10 bar is provided by means of a separate compressor 32. The gun is tubular and has a relatively large diameter, wherein at the upstream end of the gun there is mounted a fan 33 powered by an electric motor 34 which sucks in and blows out air at high velocity. A large number of water and compressed air nozzles 36, 37 are found around mouth 35 of the gun for the atomisation of the mixture and the formation of snow particles with the aid of the air of the air stream which is generated by the fan. The nozzles are often located in two or more rings 38, 39 along the internal periphery of the mouth. Fan guns usually weigh about 400–1000 kg and require mechanical equipment (preparation machines or the like) for their displacement on a ski slope. In addition to the water supply, it is also necessary to have a substantial supply of electricity for the motor 34. A system of this kind is described in, inter alia, DE-Al-3015020.

The present invention is directed towards a snow gun wherein the compressed air expands before atomised water is added. By using an ejector as an accessory, the snow guns according to the invention will be less affected by wind and weather, and at the same time the ejector will cause an intake of additional dry air.

The snow gun according to the invention is lighter than the existing fan and tower guns, and also generates a lower level of noise. As regards noise from snow guns, this is a problem today, especially in ski areas which are close to a built-up area. The environmental requirements set by the authorities are increasingly stringent, and this means that a number of existing snow guns cannot be operated at night because they cause an excessively high level of noise.

The characterising features of the invention will be apparent from the following description with reference to the attached drawings, and also from the attached patent claims.

FIG. 1 is a side elevational view of a water/compressed air system according to prior art;

FIGS. 2*a* and 2*b* show a tower gun system according to the prior art;

FIGS. 3*a* and 3*b* show a fan system according to the prior art;

FIG. 4*a* is a schematic illustration of the snow gun according to the present invention.

FIG. 4*b* shows a modification of the snow gun is FIG. 4*a*.

Figure 4A:
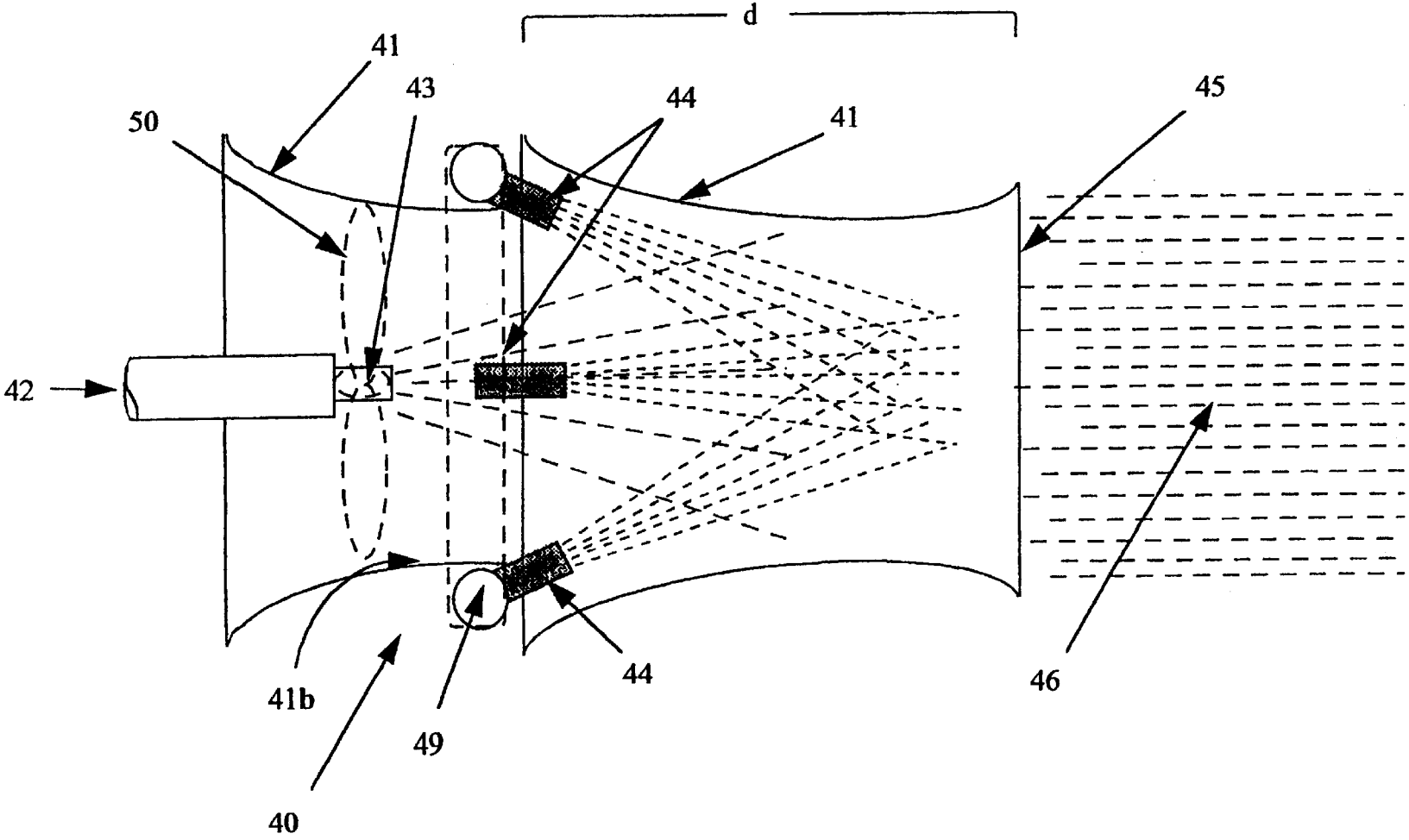
Figure 4B:
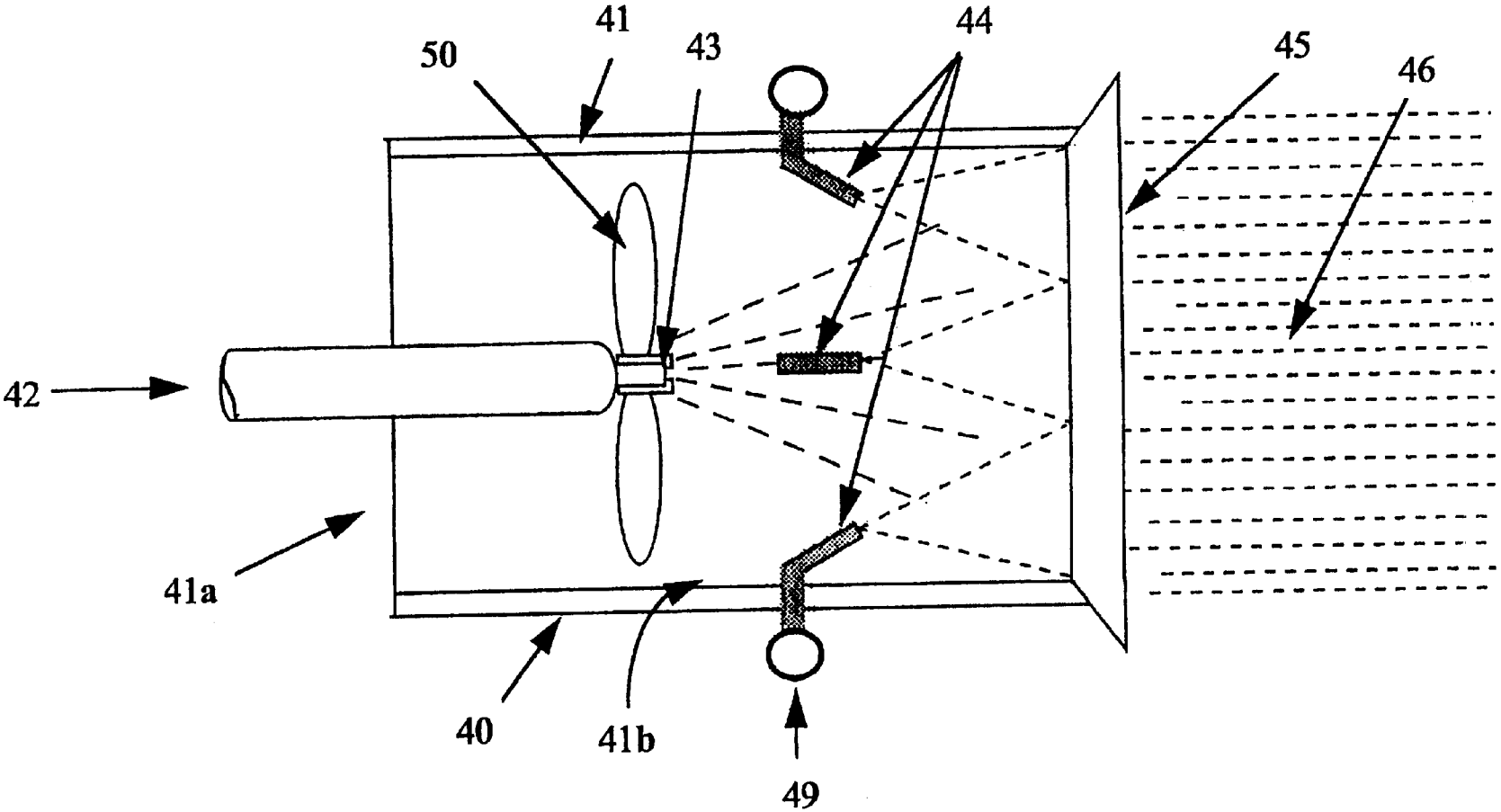

FIG. 4 is a schematic illustration of the present invention. The snow gun 40 has a tubular housing 41 wherein at a rear edge of the housing 41 there is an air supply 42 with air aperture (nozzle) 43. The water nozzles 44 are located downstream and at a distance from the air nozzle 43, in the direction of but at a distance d from the outlet opening 45 of the housing 41. The compressed air 42 which exits through the aperture 43 expands, as indicated in broken lines, in dry air before it meets and mixes with atomised water from the water nozzles 44 to form artificial snow 46.

The snow gun according to the invention gives a better cooling of the expanding compressed air than is possible with the conventional water/air guns and the tower guns. The cooling of the gun is improved, and it is sufficient to have a lower water pressure than is the case, e.g., for tower guns. For instance, a water pressure in the range of about 7.5–20 bar will be sufficient for full utilisation capacity. This has substantial advantages with a view to safety, dimensioning, pressure classes etc. The water nozzles 44 are either typical flat jet nozzles or approximately such nozzles, or a substantial number of ordinary nozzles. Where the water jets from the nozzles first meet, they form together a configuration having approximately the shape of a polygon or circle, as can be seen in detail from FIG. 5 and is indicated in broken lines; reference numeral 47.

Figure 6:
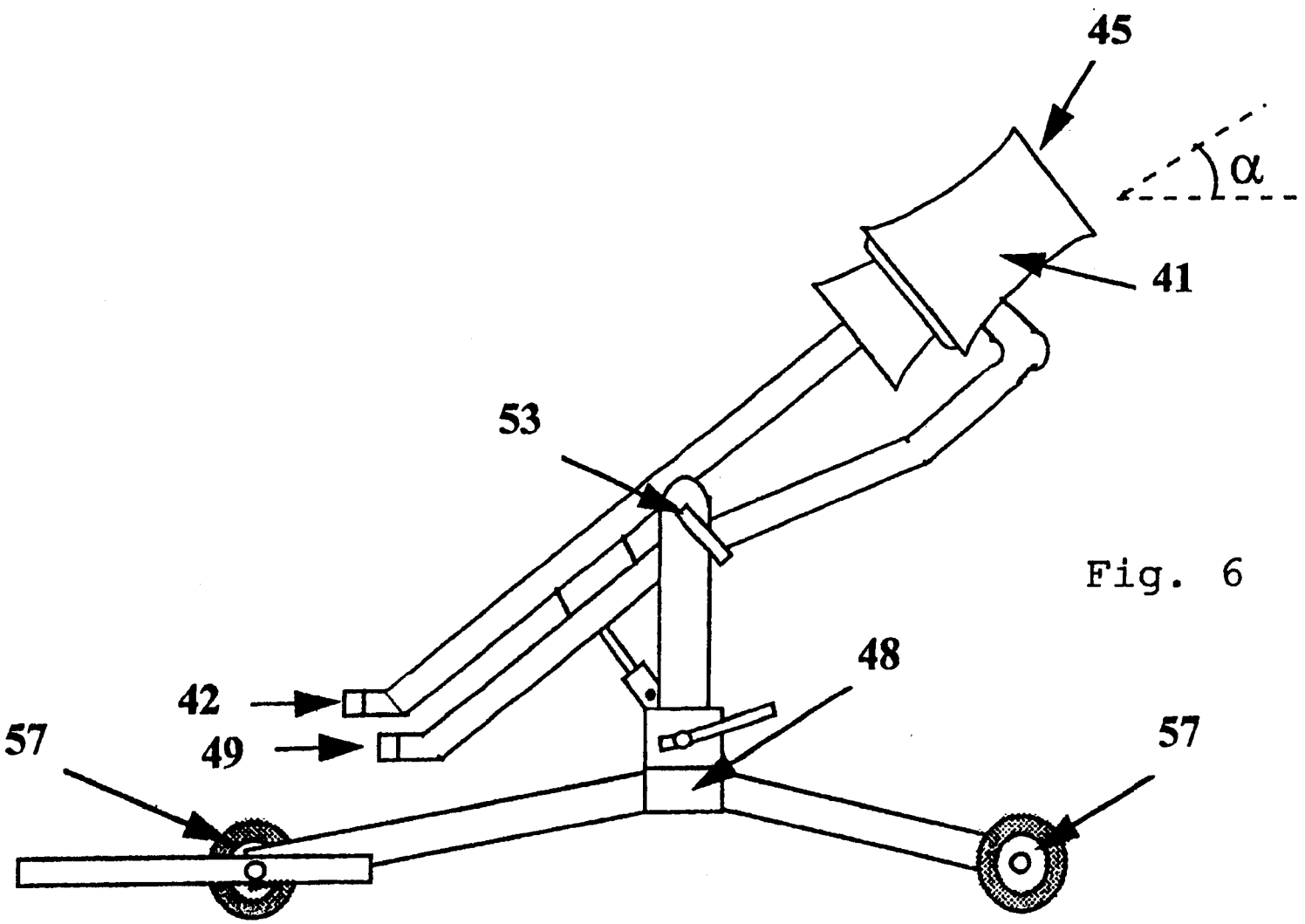
FIG. 6 shows the snow gun mounted on a sledge, carriage or other support.
Figure 7:
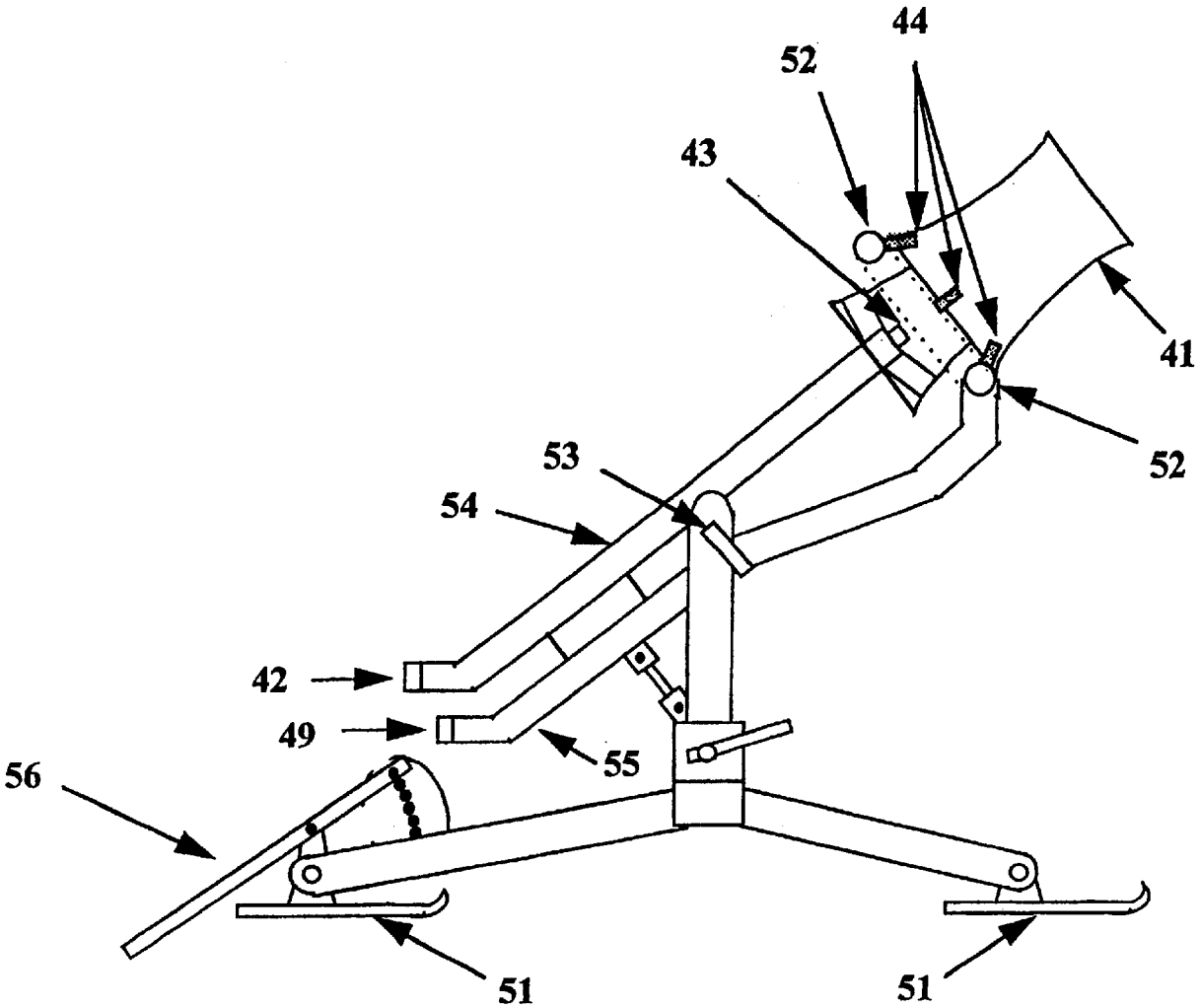
FIGS. 7–8 show a practical embodiment of the snow gun, seem from the side and from above and behind respectively.
Figure 8:
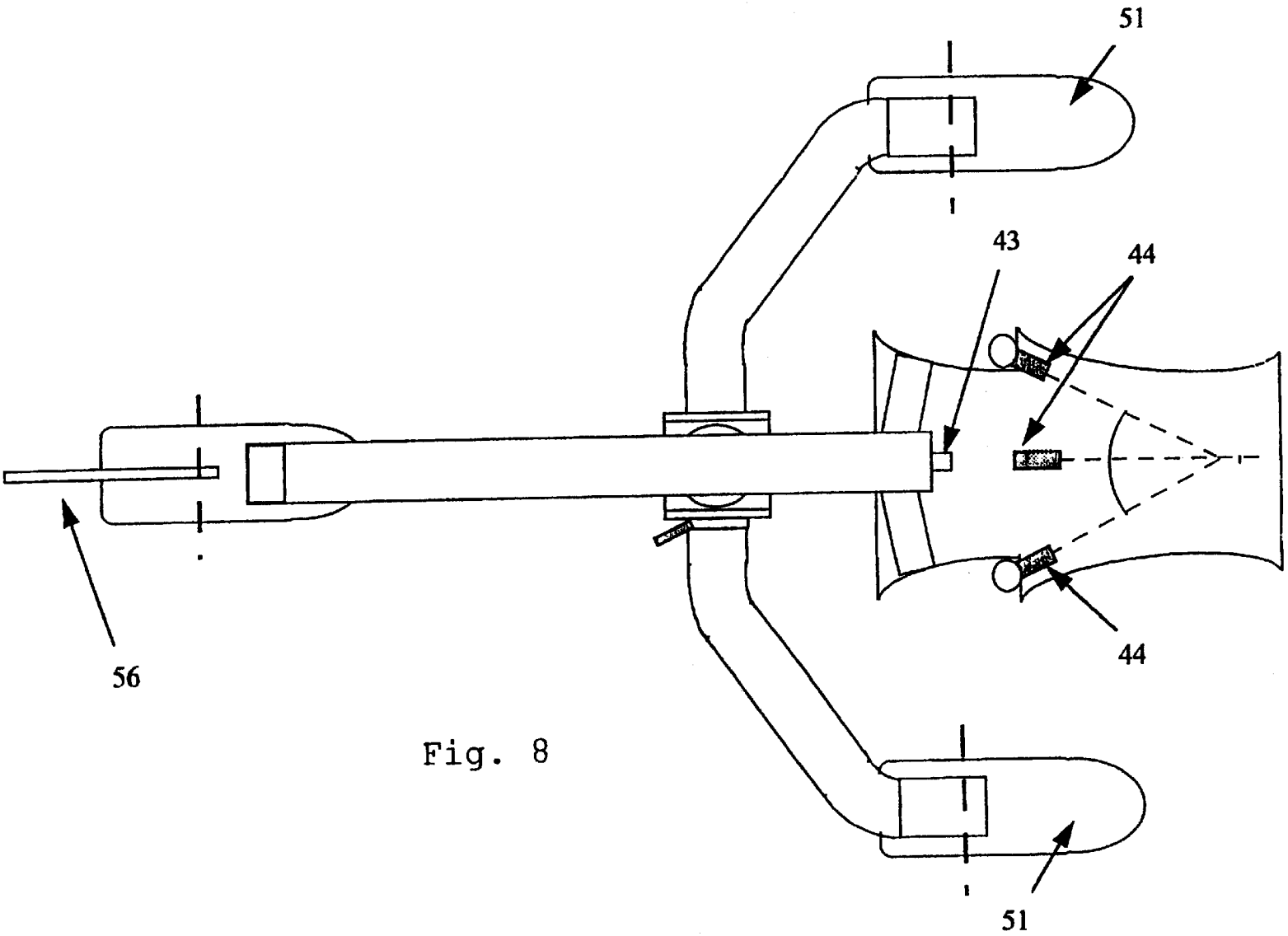

The snow guns can be mounted on sledges or carriages, whereby it becomes considerably easier to deposit the snow as necessary in the ski tracks or on the runs. FIG. 6 shows a snow gun placed on a wheeled carriage 48. The carriage 48 may optionally be equipped with runners 51 instead of wheels 57. The ejection angle $\alpha$ can be adjusted in a simple manner. The stable mounting will ensure that the reaction force is intercepted. By designing the housing 41 as an ejector (typically a Bernouilli tube), it will in addition be possible to obtain enhanced directional stability for jet of ejected snow, and also to obtain a better effect in that at the inlet end of the snow gun dry, cold additional air is drawn in. At the same time the ejector or housing 41 provides protection against the elements in the air and water mixing zone, so that the snow gun thus has a better directional effect, in sharp contrast to the known solutions.

To increase the air supply further, a fan 50 can be placed at the inlet 41*a* of the housing 41. The fan 50 can, e.g., be operated by compressed air from the air supply 42, or operated by the pressurised water supplied.

Figure 5:
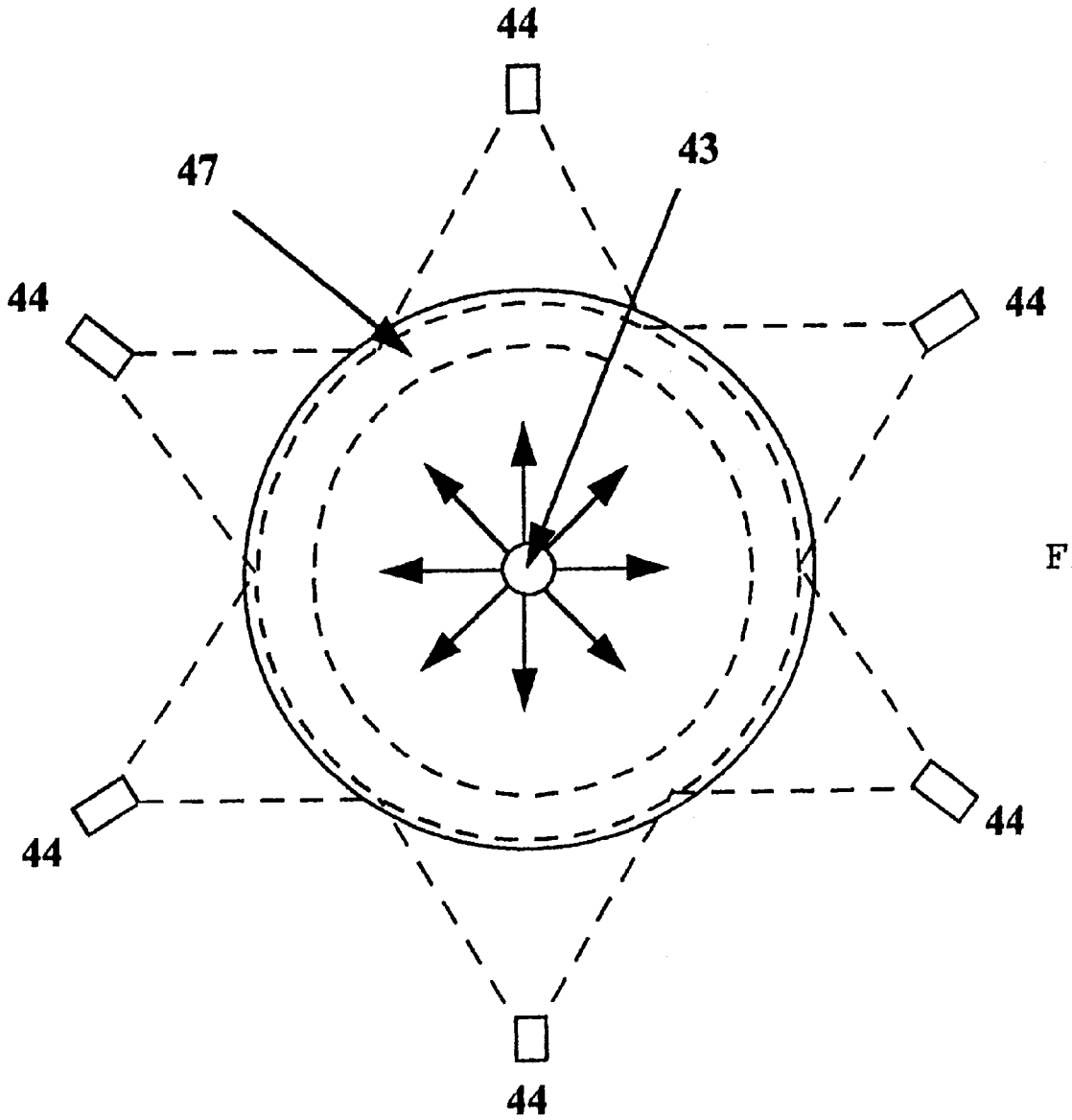
FIG. 5 is a schematic illustration of expanding air exiting an air nozzle head in relation to the snow gun water nozzles.

Since the water jets from each of the water nozzles 44 together form at the meeting of the jets a configuration having approximately the shape of a circle 47 or polygon, an optimal and even distribution between water 49 and expanding air 42 will be obtained, The water nozzles 44 are, as indicated in FIG. 4 and FIG. 5, placed in a ring shape around the internal wall of the housing, spaced apart at regular intervals. The water nozzels preferably form an angle with the internal wall 41*b* of the housing, e.g., in the range of 10–70°, preferably 600°. The water 49 is supplied to the nozzles 44 via a common supply line 52. This will give a better effect and a more substantial production of snow particles compared with the traditional snow guns.

In contrast to fan guns which require mechanical equipment for displacement and in contrast to tower guns which are fixedly mounted, the snow gun according to the present invention can be moved on the ski slope with the aid of runners 51 or carriage wheels 57 by just one man, the snow gun having a low weight, typically less than 200 kg, unlike the known guns which weigh about 500 kg or more. The snow gun according to the invention can of course also be mounted on site on a tower or on machines if so desired. The sledge or carriage may optionally be height-adjustable.

The snow gun according to the present invention has been found to have a low level of noise compared with traditional water/air guns. The compressed air is the greatest source of noise, and this can be easily deadened by means of an ordinary air or gas exhaust silencer. It has been found to be difficult to silence the noise of the known water/air guns which have a varying mixture of water and air which flows at high speed out of a nozzle.

Figure 1:
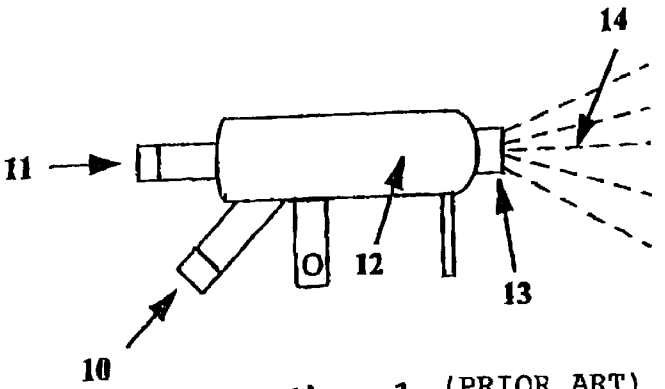
Fig. 1 (PRIOR ART)
Figure 2B:
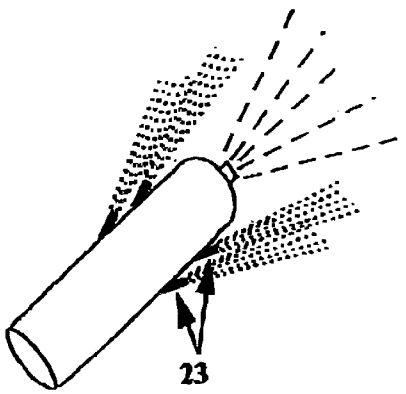
Fig. 2b (PRIOR ART)
Figure 2A:
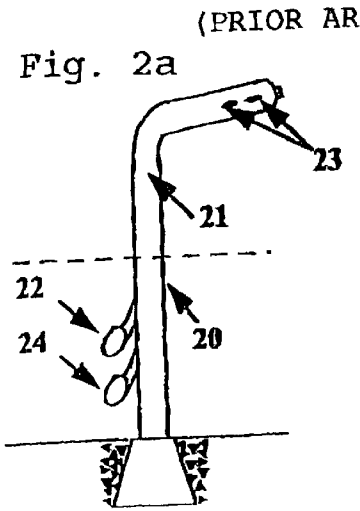
Fig. 2a (PRIOR ART)
Figure 3A:
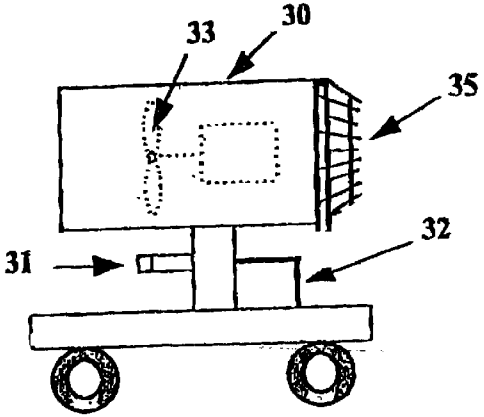
Fig. 3a (PRIOR ART)
Figure 3B:
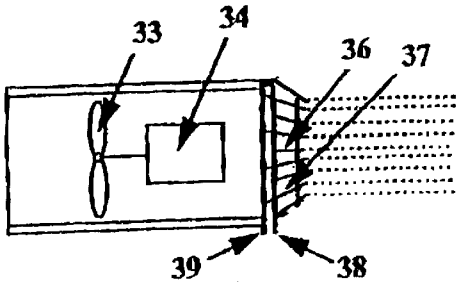
Fig. 3b (PRIOR ART)

Furthermore, the snow gun according to the invention has the advantage that under normal operation no moveable parts are required, such as a propeller powered by an electric motor. By doing away with any electrical connection, the operation is simplified considerably. If additional operation with a propeller 50 is desired, this can be powered by the compressed air 42 or the pressurised water 49. The compressed air steam will be considerably colder owing to the expansion after the nozzle 43 than can be provided alternatively using only a fan-based solution, as shown in FIG. 3.

Within the scope of the invention, it is also conceivable to supply compressed air to the nozzles 44 in order to effect an improved dispersal of the outflowing water.

The carriage or sledge is connected to the snow gun via a swivel 53. The supply pipes 54 and 55 for the air 42 and the water 49 respectively can be secured to a recoil support 56 which when the axis of the snow gun is tilted upwards, forms contact and engagement with the ground and thus forms a three-point support for the snow gun together with the sledge runners 51.

What is claimed is:

1. A snow gun (40) having a tubular housing (41), outlet (43) for cold compressed air (42) and outlet (44) for water (49) discharged under pressure, said outlet for water consisting of nozzles (44) disposed along a ring-shaped cross-sectional area of the housing, each nozzle forming an angle relative to an internal wall (41*b*) of the housing, and said nozzles (44) being located downstream in relation to the compressed air outlet (43) where the compressed air expands, characterized in that said nozzles are located upstream in relation to an outlet aperture (45) of the housing, and that both are outlet (43) for compressed air (42) and the water nozzles (44) are thus surrounded by the tubular housing (41) between an inlet end (41*a*) and the outlet aperture (45) of the housing, and that water jets from the nozzles (44), where they meet upstream in relation to the outlet aperture (45) of the housing, form a configuration having approximately the shape of a polygon or circle (47), there being a fan (50) downstream in relation to the inlet end (41*a*) of the housing (41), said fan (50) being located coaxial with the housing (41) axis and being operated by the pressurised water which in addition is fed to the water nozzles (44).

2. A snow gun according to claim 1, characterised in that the water outlet nozzles (44) are flat jet nozzles.

3. A snow gun according to claim 1, characterised in that the compressed air outlet (43) is located coaxial with the central axis of the housing (41).

4. A snow gun according to claim 1, characterised in that the tubular housing (41) is made approximately in the form of a Bernoulli tube to form a snow ejector.

5. A snow gun according to claim 1, characterised in that a fan (50) is located downstream in relation to the inlet end (41*a*) of the housing (41), and that the fan (50) is located coaxial with an inlet pipe for the compressed air (42) and is operated by means of the compressed air.

* * * * *